US005319821A

United States Patent [19]

Nicholson et al.

[11] Patent Number: 5,319,821

[45] Date of Patent: Jun. 14, 1994

[54] CEILING FAN CLEANING APPARATUS

[75] Inventors: Roy V. Nicholson, Hickory, N.C.; Gregory A. Harris, Nashville, Tenn.; Darrell M. Merino; Robert W. Lackey, both of Hickory, N.C.

[73] Assignee: R.L. Products Corporation, Hickory, N.C.

[21] Appl. No.: 864,624

[22] Filed: Apr. 7, 1992

[51] Int. Cl.[5] ..... A46B 17/08

[52] U.S. Cl. ..... 15/104.8; 15/106; 15/144.3

[58] Field of Search ..... 15/104.8, 144 B, 106

[56] References Cited

U.S. PATENT DOCUMENTS

D. 296,022 5/1988 Restivo .
D. 304,106 10/1989 Dobson .
1,669,302 5/1928 Lannan ..... 15/104.8
2,276,264 5/1940 Goldfinger .
2,277,444 3/1942 McPhee .
2,659,924 11/1953 Forsberg ..... 15/395
3,110,923 8/1961 Berleme .
3,381,334 4/1967 Redmond .
3,989,388 11/1976 Spain .
4,458,375 7/1984 Killeen .
4,823,431 4/1989 Carpenter .
4,827,556 5/1989 Corsetti .
4,841,592 6/1989 Restivo .

FOREIGN PATENT DOCUMENTS 160686 1/1955 Australia ..... 15/394

*Primary Examiner*—Chris K. Moore
*Attorney, Agent, or Firm*—Hardaway Law Form

[57] ABSTRACT

A lightweight, highly maneuverable and extendable apparatus for cleaning ceiling fan blades, having a dust receptacle carried beneath a mounted brush which is designed to clean the exterior surfaces of a ceiling fan, the apparatus carried by a lightweight telescopic handle and capable of reaching high ceiling fans.

7 Claims, 1 Drawing Sheet

CEILING FAN CLEANING APPARATUS

BACKGROUND OF INVENTION

This invention relates generally to the art of cleaning devices and more particularly to an apparatus for cleaning the exterior surfaces of ceiling fans.

While there are a variety of apparatuses which can be employed to clean a fan blade, these implements are generally unsatisfactory for safe, rapid and efficient cleaning of ceiling fan blades. Current cleaning aids are generally ill-suited for cleaning the upper surface of the ceiling fan blade, forcing the user to use a ladder or stool to reach the upper blade surfaces. Other cleaning tools require bulky vacuum hoses or attachments which limit the reach and mobility of the cleaning device.

U.S. Pat. No. 3,110,923 to Berlime shows an attachment for vacuum cleaning venetian blind slats. However, Berlime's apparatus does not provide a mechanism for securely engaging ceiling fan blades. As such, the blades continue to rotate while being cleaned. Berlime also discloses the use of a vacuum source to remove accumulated dust. Berlime does not provide a dust receptacle for catching and storing displaced dust and does not facilitate the cleaning of a fan's motor housing or lights.

Carpenter in U.S. Pat. No. 4,823,431, discloses a fan blade cleaning apparatus which securely engages the fan blade. However, various embodiments of Carpenter's apparatus either allows the dust to fall onto the room's floor and furnishings or incorporates the use of a vacuum device to remove the dust. The former embodiments require additional cleaning steps, while the later embodiments have the inherent limitations of any vacuum assisted device; namely, an increase in size and weight along with decreased mobility and ease of operation. Further, Carpenter's apparatus is not suited for cleaning the non-blade portions of a ceiling fan.

The present invention allows the user to easily clean all parts of a ceiling fan including the blades, light fixtures, motor housing and other external parts while remaining safely at ground level. The apparatus can safely clean a variety of fan shapes, sizes and materials. In addition, the apparatus is portable, lightweight, and requires no accessory power source or attachments. The present apparatus is particularly suitable for the cleaning of ceiling fans which are mounted on high ceilings. Such fan locations are often inaccessible to conventional cleaning apparatuses which operate by a vacuum system as such systems have inherent limitations upon their reach and mobility.

SUMMARY OF THE INVENTION

It is thus an object of the present invention to provide an improved means for safely cleaning the surfaces of a ceiling fan, including the blade, light fixtures and motor housing, while the user remains safely on ground level.

It is a further object of the invention to provide an apparatus for cleaning the surfaces of a ceiling fan which provides a dust receptacle for retaining dust removed from the ceiling fan.

It is still a further object of the invention to provide a light-weight, portable, and easy to elevate cleaning apparatus for ceiling fans which does not require the use of a vacuum attachment.

DETAILED DESCRIPTION

According to this invention, it has been found that a desirable fan brush apparatus can be provided comprising a wire brush having a first terminus and a second terminus, the second terminus defining an attachment means for securing the brush to a dust pan carried below the brush, the dust pan having an upper surface and a lower surface, the first attachment means engaging the dust pan along an upper surface of a first end of the pan; a rod, by second attachment means attached to the lower pan surface of the first pan end; wherein the dust pan is positioned beneath the brush for collecting dust displaced by the brush from a ceiling fan blade. If desired, the fan brush apparatus can be provided wherein the dust pan or the brush are rotatable in relationship to each other so that the user may have an unobstructed view of the surfaces of the ceiling fan to be cleaned.

Figure 1:
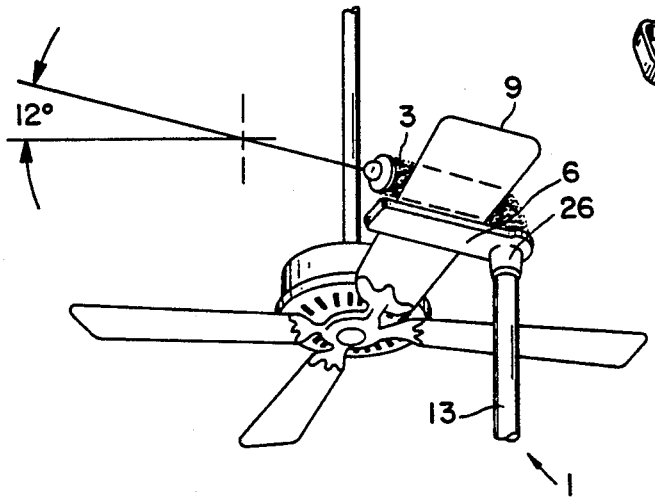
FIG. 1 is an isometric view of an embodiment of the blade cleaning apparatus seen engaging the upper surface of a ceiling fan blade.
Figure 2:
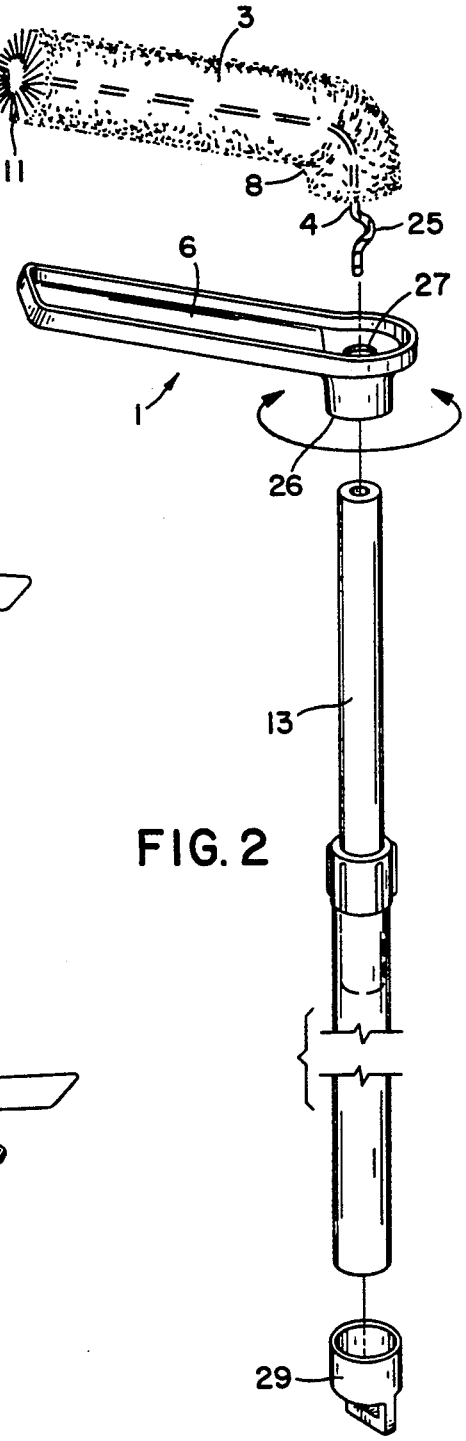
FIG. 2 is an exploded perspective view of the apparatus seen in FIG. 1.
Figure 3:
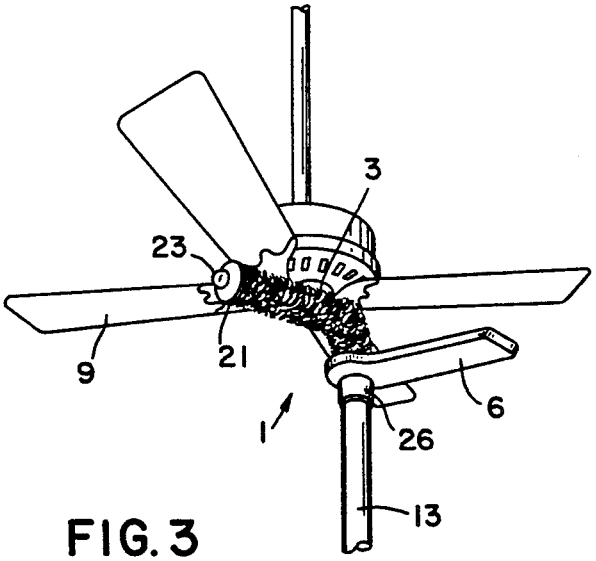
FIG. 3 is an isometric view of the apparatus seen in FIG. 1 as used to clean the motor housing and light fixtures of a ceiling fan.

A preferred embodiment of the invention, seen in FIGS. 1 through 3, provides a brush cleaning apparatus 1 with an L-shaped spiral brush 3 with numerous erect bristles 11 having a first free end 2, an attached end 4 and an intervening right angled elbow 8. As best seen in FIG. 2, a wire detent 25 projects from end 4 of brush 3. A dust receptacle or pan 6 provides a molded aperture 27 in which wire detent 25 is firmly engaged, securing the brush in a fixed position. Dust pan 6 has a lower sleeve 26 below aperture 27 which connects to a plastic telescoping rod 13. Wire detent 25 may be used to additionally secure rod 13 within sleeve 26. Alternatively, a separate securing means can be used to engage rod 13 to pan 6. Pan 6 as seen in FIG. 3 is designed to be rotatable through sleeve 26 about rod 13 while brush 3 remains in a fixed position.

In reference to FIG. 1, when brush 3 is used to engage the upper blade surface of a ceiling fan, the blade 9 is positioned between brush 3 and pan 6. Pan 6 collects and stores any displaced dust which may happen to fall from brush 3. An elbow 8 of brush 3 helps clean the edge portions of blade 9. It has been found that a plastic retaining ring 21 secured to free end 2 by an end cap 23 helps secure and guide the brush along the length of blade 9.

As seen in FIG. 3, the rotatable pan 6 can be rotated away from brush 3, allowing the user an unobstructed view for cleaning light fixtures and motor housings of a ceiling fan. Pan 6 should rotate a full 180° about rod 13 to provide an unobstructed access and view for cleaning the non-blade portions of the ceiling fan. As illustrated by the directional arrow in FIG. 2, the illustrated embodiment enables sleeve 26 and pan 6 to freely pivot about rod 13. Similarly, this arrangement can be used to clean the lower surfaces of fan blade 9 as well. An equivalent structure could be provided by having brush 3 being rotatable about pan 6.

This particular embodiment of the ceiling fan cleaning apparatus 1 is extremely light and easy to use. Ideally, rod 13, bristles 11 and pan 6 are constructed of a lightweight, nonconducting plastic. The lightweight and compact design allows apparatus 1 to be stored by a hook loop 29 attached to the free end of rod 13.

Many variations may be apparent to those skilled in the art from the reading of the above description which is exemplary in nature. Such variations are embodied in the spirit and scope of this invention as measured by the following appended claims.

That which is claimed:

1. A fan brush apparatus comprising:

a bent wire brush having a first terminus and a second terminus, said second terminus carrying a detent attachment hook;

a dust pan carried below said brush by a rod, said pan having an upper surface and a pivoting end, said detent attachment hook engaging said upper dust pan surface within a molded aperture said pan being rotatable beneath said brush;

wherein said dust pan occupies a first position beneath said brush, said dust pan rotating to a second position away from said brush thereby facilitating the cleaning of a non-blade portion of a ceiling fan.

2. A fan brush apparatus comprising:

a wire brush having a first terminus and a second terminus, said second terminus defining a brush attachment means;

a dust pan carried below said brush said brush attachment means engaging an upper surface of a first end of said pan;

a rod, said rod attached to a pivot defined by a lower pan surface of said pan first end;

wherein said dust pan occupies a first position beneath said brush said dust pan rotating to a second position away from said brush and thereby facilitates the cleaning of a non-blade portion of a ceiling fan.

3. The apparatus according to claim 2 wherein said rod is telescopic.

4. The apparatus according to claim 2 wherein said rod is constructed of a non-conductive material.

5. The apparatus according to claim 2 wherein said dust pan is rotatable 180° about said rod.

6. The apparatus according to claim 2 wherein said brush is rotatable 180° about said rod.

7. A fan brush comprising:

a brush means having a first terminus and a second terminus, said second terminus further defining an attachment means for securing said brush means to a handle;

a dust receptacle attached to said handle by rotational means, said dust receptacle carried beneath said brush means;

wherein said dust receptacle occupies a first position beneath said brush means for collecting dust, said dust receptacle rotating to a second position away from said brush.

* * * * *